US008707975B2

(12) United States Patent
Larson et al.

(10) Patent No.: US 8,707,975 B2
(45) Date of Patent: Apr. 29, 2014

(54) CRUTCH

(75) Inventors: Brad J. Larson, North Logan, UT (US); Ken Lester, North Logan, UT (US)

(73) Assignee: Millennial Medical Equipment, LLC, Logan, UT (US)

( * ) Notice: Subject to any disclaimer, the term of this patent is extended or adjusted under 35 U.S.C. 154(b) by 0 days.

(21) Appl. No.: 13/315,095

(22) Filed: Dec. 8, 2011

(65) Prior Publication Data

US 2012/0255589 A1 Oct. 11, 2012

Related U.S. Application Data

(63) Continuation-in-part of application No. 12/577,595, filed on Oct. 12, 2009, now abandoned, which is a continuation-in-part of application No. 11/854,971, filed on Sep. 13, 2007, now abandoned, which is a continuation-in-part of application No. 10/960,823, filed on Oct. 7, 2004, now Pat. No. 7,434,592, which is a continuation-in-part of application No. 10/461,578, filed on Oct. 10, 2003, now Pat. No. 7,104,271.

(60) Provisional application No. 60/825,804, filed on Sep. 15, 2006.

(51) Int. Cl.
*A45B 9/04* (2006.01)

(52) U.S. Cl.
USPC ..... 135/77; 135/82; 135/84

(58) Field of Classification Search
USPC ..... 135/77, 82, 84, 86
See application file for complete search history.

(56) References Cited

U.S. PATENT DOCUMENTS

| | | | | |
|---|---|---|---|---|
| 26,829 | A | | 1/1860 | Bickel |
| 1,548,889 | A | | 8/1925 | King |
| 2,197,279 | A | | 4/1940 | Thorssen |
| 2,453,632 | A | | 11/1948 | Lofstrand, Jr. |
| 2,690,188 | A | | 9/1954 | Goddard |
| 2,741,255 | A | | 4/1956 | Neptune |
| 2,888,022 | A | | 5/1959 | Fanning |
| 2,910,995 | A | | 11/1959 | Jacuzzi |
| 3,040,757 | A | * | 6/1962 | Smith ..... 135/86 |
| 3,099,103 | A | * | 7/1963 | Wright ..... 248/188.8 |
| 3,133,551 | A | | 5/1964 | Murcott |
| 3,174,494 | A | | 3/1965 | Maguire |
| D204,849 | S | | 5/1966 | Thomas |
| 3,269,399 | A | | 8/1966 | Smith |
| 3,335,735 | A | | 8/1967 | Colegrove et al. |
| 3,517,678 | A | | 6/1970 | Gilsdoft |
| 3,635,233 | A | | 1/1972 | Robertson |
| 3,741,226 | A | * | 6/1973 | Urban ..... 135/84 |
| 3,947,140 | A | | 3/1976 | Thomas |
| 3,995,650 | A | | 12/1976 | DiVito |

(Continued)

FOREIGN PATENT DOCUMENTS

| | | |
|---|---|---|
| FR | 371.291 | 3/1907 |
| GB | 2 340 402 | 2/2000 |
| JP | 20013530101 | 12/2001 |
| JP | 2003062021 | 3/2003 |

*Primary Examiner* — Noah Chandler Hawk
(74) *Attorney, Agent, or Firm* — Maywood IP Law; David W. Meibos

(57) ABSTRACT

An articulated grip pad is disclosed which includes a vertical supporting member that has a generally spherical bottom end. The crutch also includes a gripping pad having a bore. The generally spherical end of the vertical support is securely received into the bore.

20 Claims, 8 Drawing Sheets

(56) References Cited

U.S. PATENT DOCUMENTS

| | | | | | |
|---|---|---|---|---|---|
| 4,135,536 | A | | 1/1979 | Willis | |
| 4,151,853 | A | | 5/1979 | Inbar | |
| 4,184,503 | A | | 1/1980 | Nakajima | |
| 1,348,531 | A | | 8/1980 | Amadio | |
| 4,237,915 | A | | 12/1980 | Zabielski et al. | |
| 4,253,478 | A | | 3/1981 | Husa | |
| 4,440,186 | A | | 4/1984 | Lottner | |
| 4,509,741 | A | | 4/1985 | Smith | |
| 4,510,957 | A | | 4/1985 | Frank | |
| 4,630,626 | A | * | 12/1986 | Urban | 135/84 |
| 4,763,680 | A | | 8/1988 | Acosta, Sr. | |
| 4,787,405 | A | | 11/1988 | Karwoski | |
| 4,869,280 | A | | 9/1989 | Ewing | |
| 4,917,126 | A | | 4/1990 | Ellmore | |
| 4,947,882 | A | | 8/1990 | Levasseur | |
| 4,958,651 | A | | 9/1990 | Najim | |
| 5,038,811 | A | | 8/1991 | Gilmore | |
| 5,139,040 | A | | 8/1992 | Kelly | |
| 5,193,567 | A | * | 3/1993 | Razny, Jr. | 135/68 |
| 5,201,334 | A | | 4/1993 | Tseng | |
| 5,318,058 | A | | 6/1994 | Zimmerman | |
| 5,325,879 | A | | 7/1994 | Burns | |
| 5,331,989 | A | | 7/1994 | Stephens | |
| 5,339,850 | A | | 8/1994 | Mertz | |
| 5,458,143 | A | | 10/1995 | Herr | |
| 5,606,985 | A | | 3/1997 | Battiston et al. | |
| 5,628,335 | A | | 5/1997 | Free | |
| 5,671,765 | A | | 9/1997 | Hagberg, Jr. | |
| 5,673,719 | A | | 10/1997 | Shofner | |
| 5,711,334 | A | | 1/1998 | Roux | |
| 5,720,474 | A | | 2/1998 | Sugiyama | |
| 5,725,005 | A | | 3/1998 | Yamasaki et al. | |
| 5,771,910 | A | | 6/1998 | Kluttz | |
| 5,860,439 | A | | 1/1999 | Ostertag | |
| 5,865,180 | A | | 2/1999 | Sigfrid | |
| 5,924,434 | A | | 7/1999 | Cato, III | |
| 6,055,998 | A | | 5/2000 | Bader | |
| 6,138,699 | A | | 10/2000 | Su | |
| 6,164,305 | A | | 12/2000 | Herman | |
| 6,286,529 | B1 | | 9/2001 | Olivera | |
| 6,378,541 | B1 | | 4/2002 | Matthews | |
| 6,537,117 | B1 | | 3/2003 | Larson et al. | |
| H2138 | H | | 1/2006 | Pullman et al. | |
| 7,025,072 | B2 | | 4/2006 | McGrath | |
| 7,104,271 | B2 | | 9/2006 | Larson et al. | |
| 2001/0027802 | A1 | | 10/2001 | McGrath | |
| 2001/0032662 | A1 | | 10/2001 | Battiston | |
| 2003/0098051 | A1 | | 5/2003 | Fismer | |
| 2004/0025926 | A1 | | 2/2004 | Gin et al. | |
| 2004/0250845 | A1 | | 12/2004 | Rudin et al. | |

* cited by examiner

CRUTCH

CROSS-REFERENCE TO RELATED DOCUMENTS

This application is a continuation-in-part of U.S. patent application Ser. No. 12/577,595, filed Oct. 12, 2009, entitled A CRUTCH, which claims the benefit of U.S. Provisional Patent Application Ser. No. 60/825,804, filed Sep. 15, 2006. U.S. patent application Ser. No. 12,577,595 is also a continuation-in-part of U.S. patent application Ser. No. 11/854,971, filed Sep. 13, 2007, entitled ERGONOMIC FOREARM CRUTCH, which is a continuation-in-part of U.S. patent application Ser. No. 10/960,823, filed Oct. 7, 2004, now U.S. Pat. No. 7,434,592, entitled ERGONOMIC COLLAPSIBLE CRUTCH, which is a continuation-in-part of U.S. patent application Ser. No. 10/461,578, filed Oct. 10, 2003, now U.S. Pat. No. 7,104,271, entitled ERGONOMIC COLLAPSIBLE CRUTCH. All of the above are incorporated herein by reference.

BACKGROUND OF THE INVENTION

The present invention is directed to medical devices for ambulatory care and more particularly ergonomic crutches. A crutch is generally defined as a medical device that is used to support all or part of a patient's body weight. Crutches have traditionally been made of wood or metal, and are ordinarily long enough to reach from a patient's underarm to the walking surface. Full-sized convention crutches typically a concave surface fitting underneath the arm, and a cross bar for the hand, both used for supporting the body weight. Crutches may be used by a patient for only a few days or, in some instances, a lifetime.

One variation of traditional crutches is a forearm crutch. A forearm crutch, like a full-sized conventional crutch, is used to transfer part of a patient's body weight to their hands and arms while walking. As the name would indicate, forearm crutches extend from a patient's forearm rather than the patient's underarm. Forearm crutches are often employed where a patient is able to manage without the necessity of a full length crutch.

On occasion, crutches have been observed to cause or lead indirectly to multiple injuries and disorders despite their ability to transfer weight. Each repetition of usage of the crutch may be injurious and can produce micro-trauma to the tissues and joints of the body. Although the human body has enormous self-repair abilities, continued exposure to such activities can outweigh these abilities, which then results in injury.

BRIEF SUMMARY OF THE INVENTION

In one aspect, an articulated grip pad includes a vertical supporting member of a crutch having a generally spherical bottom end and a gripping pad having a bore. The generally spherical end is securely received into the bore. Implementations may include the following feature. A socket may be disposed in the bore between a bottom portion of the bore and the generally spherical end of the vertical support.

In another aspect, a crutch includes a vertical supporting member, a ball coupled to a bottom end of the vertical supporting member, and a gripping pad having a socket. The ball is securely received into the socket to form a ball and socket joint. Implementations may include one or more of the following features. The socket may include a washer. The socket may include a concave disk. The socket may include a hemispherical surface. The ball and socket joint may include a lubricant. The gripping pad may include an annular groove disposed on its exterior surface. The vertical support may include a shock absorbing device. The shock absorbing device may include a sleeve, a spring, and shock bar, wherein the shock bar is attached to the sleeve and the spring is coupled to the shock bar, wherein the spring rate of the spring is adjustable. The vertical support comprises a shock absorbing device having a spring coupled to a shock bar. The spring rate of the spring may be adjustable. The shock absorbing device may include a sleeve having an external thread that engages an internal thread of the adjustable portion. The sleeve comprises a guide pin may extend through a longitudinally elongated aperture of the shock bar. The shock bar may be rotated to adjust the spring rate of the spring. A hand grip may extend outwardly from the vertical supporting member at an angle of about 10° to about 30° downwardly below horizontal, wherein the hand grip extends outwardly from the hand grip portion at an angle such that the wrist of a user is generally maintained in a neutral position such that the user's third metacarpal is generally aligned with the user's radius. The hand grip may extend outwardly from the vertical supporting member at an angle of about 15° to about 25° downwardly below horizontal.

In another aspect, a crutch includes a vertical supporting member of a crutch having a generally spherical bottom portion, a shock absorbing device included on the vertical support member, a ball coupled to a bottom end of the vertical supporting member, and a gripping pad having a socket. The ball is securely received to form a ball and socket joint. Implementations may include one or more of the following. The gripping pad may include an annular groove disposed on its exterior surface. The socket may include a washer. The ball and socket joint may include a lubricant. The shock absorbing device may include a sleeve, a spring, and shock bar, wherein the shock bar is attached to the sleeve and the spring is coupled to the shock bar, wherein the spring rate of the spring is adjustable. The shock absorbing device may include a spring coupled to a shock bar, wherein the spring rate of the spring is adjustable, and may further include a sleeve having an external thread that engages an internal thread of the adjustable portion, wherein the sleeve having a guide pin extending through a longitudinally elongated aperture of the shock bar, wherein the shock bar is rotated to adjust the spring rate of the spring.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENTS

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

The present invention is directed to medical devices for ambulatory care and more particularly ergonomic crutches. As used herein, the term "crutch" includes canes, forearm crutches, full-sized convention crutches, and the like. While the present invention can be implemented with these various types of crutches, this description will be limited to a description of full-sized convention crutches and forearm crutches for the purpose of illustration.

Figure 1:
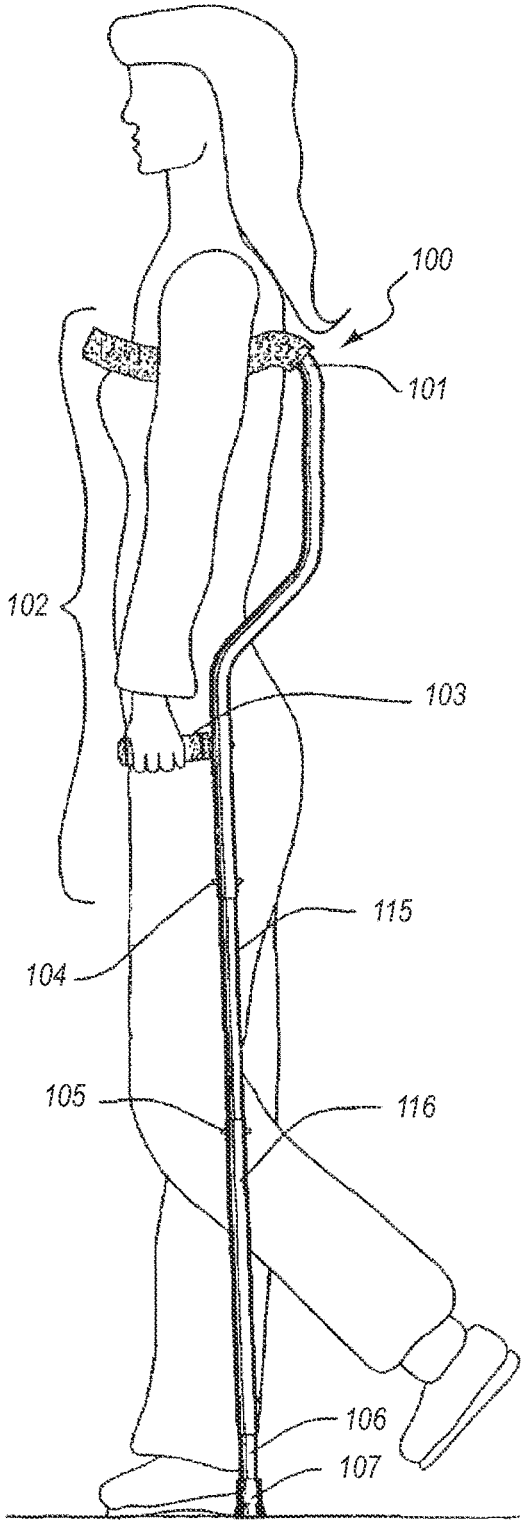
FIG. 1 is a side elevation view of an embodiment of a full-sized crutch placed in the forward orientation with respect to a patient.

FIGS. 1-4 illustrate a full-sized convention crutch. FIG. 1 illustrates an embodiment of an ergonomic collapsible crutch 100 placed in the forward orientation with respect to a patient. A patient is intended to include any user of the device. The crutch 100 includes an underarm support surface 101, a supporting member 102, a hand grip 103, an alignment rib 115, an adjustable portion 116, a shock absorbing portion 106, and a gripping pad 107. The supporting member 102 and adjustable portion 116 each have dual snap buttons 104 and 105, respectively.

The underarm support 101 located toward the proximal end of the supporting member has interchangeable cushioning pads. The underarm support 101 may be padded with an elastomeric material such as EVA, urethane foam, neoprene foam, PVC, natural rubber, cork or any other possible materials. The hand grip 103 is located toward the distal end of the supporting member 102 and has the appropriate contours and ergonomic angulation to fit the palm and align the wrist. The hand grip 103 may be fabricated of elastomeric material such as EVA, urethane foam, neoprene foam, PVC, natural rubber, cork or any other possible materials. An alignment rib 115 connects the supporting member 102 to an adjustable portion 116 to provide support, height adjustment and collapsibility.

Figure 12:
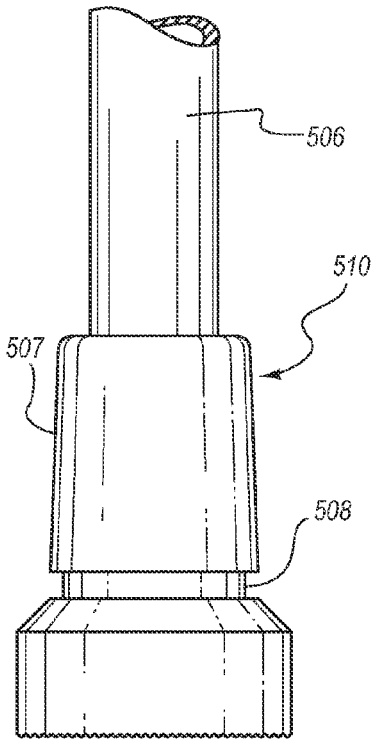
FIG. 12 is a side elevation view of an embodiment of an articulated grip pad.
Figure 13:
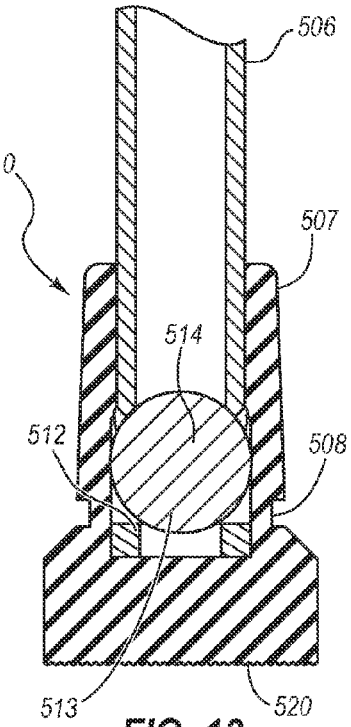
FIG. 13 is a cross-sectional side view of the articulated grip pad.
Figure 14:
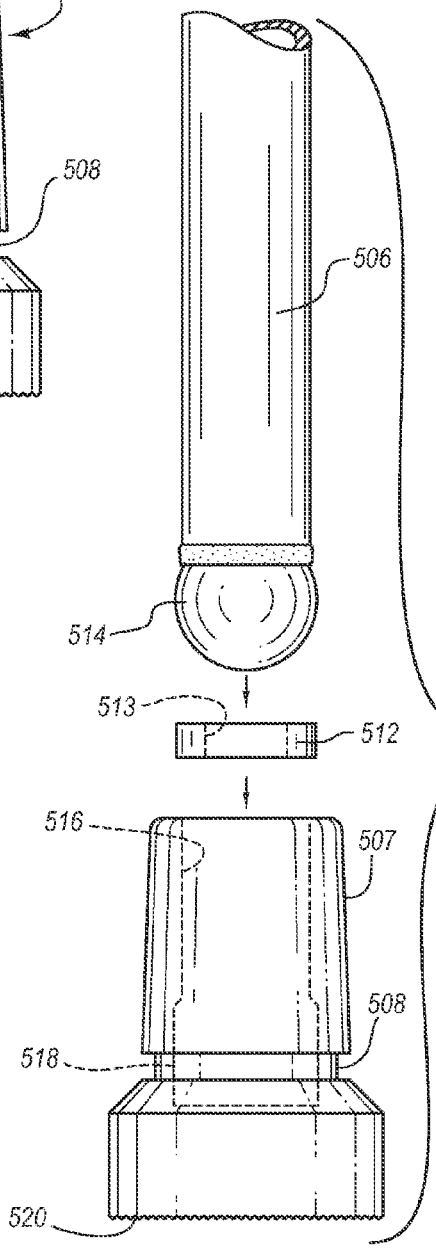
FIG. 14 is an exploded view of the articulated grip pad.

The supporting member 102, alignment rib 115 and adjustable portion 116 may be fabricated of metal such as aluminum, steel, or titanium, and are formed in a generally hollow cylindrical shape. The internal and external diameter of the supporting member 102, alignment rib 115 and adjustable portion 116 can be of varying dimensions to accommodate a patient's needs and to provide for the pieces of the crutch to fit together. For example, a pediatric patient may utilize a crutch with a smaller external diameter than an adult patient. A shock absorbing portion 106 may be used at the distal end of the adjustable portion 116 to assist in ambulating over uneven surfaces and to provide a cushioning effect. The distal end of the crutch has a gripping pad 107 that provides appropriate friction between the crutch 100 and the walking environment. The gripping pad 107 may be formed of an elastomeric material such as EVA, urethane foam, neoprene foam, PVC, natural rubber, cork or any other possible materials. In some embodiments the grip pad may be an articulated grip pad, as discussed below and as illustrated in FIGS. 12-14.

Figure 2:
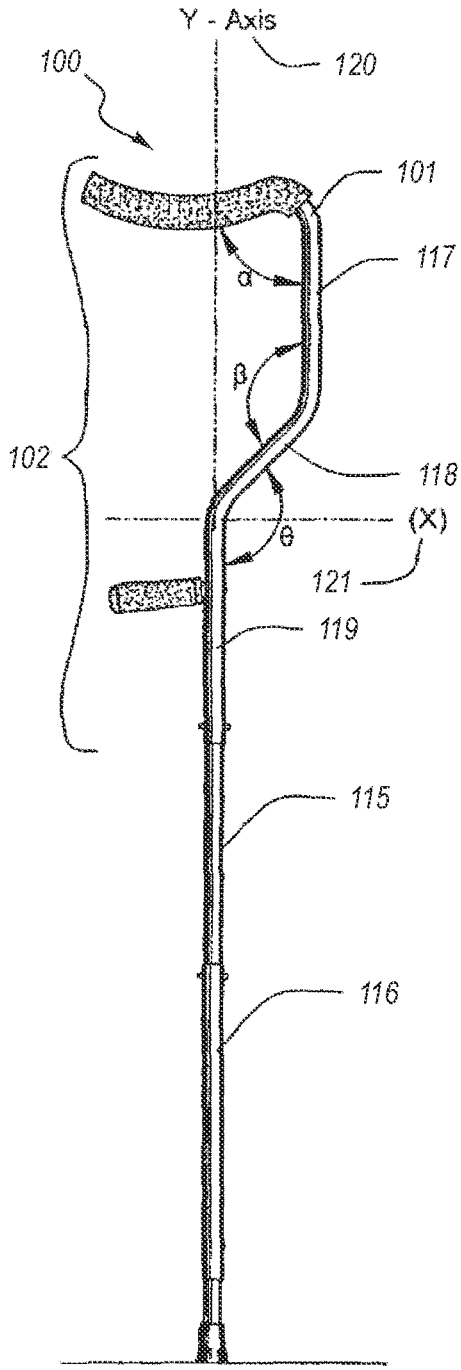
FIG. 2 is a side elevation view of an embodiment of the full-sized crutch.

FIG. 2 is a side perspective view of an embodiment of a crutch 100 that has one supporting member 102 for ease of usage and carrying. A vertical axis or y-axis 120 is drawn along the center of the alignment rib 115 and adjustable portion 116. A horizontal line or x-axis 121 is drawn perpendicular to the y-axis 120 and transects the supporting member 102. The supporting member 102 consists of four sections: the underarm support 101, the stabilizing portion 117, the middle bend portion 118, and the hand grip portion 119.

The underarm support 101 is generally parallel to the x-axis 121 and it is contoured to fit the underarm of a patient. The length of the underarm support 101 extends considerably beyond either side of a patient's arm. The underarm support 101 has a concave curvature along the top edge and a convex curvature along its underside. The concave curve along the top edge is designed to prevent slippage and provide comfort and stability to a patient.

The stabilizing portion 117 is generally parallel to the y-axis 120. The stabilizing portion 117 is configured to be at an angular orientation $\alpha$ with respect to the underarm support 101 in the range of 45° to 135°. The crutch 100 embodiment of FIG. 2 has an angular orientation $\alpha$ of approximately 90°.

The middle bend portion 118 projects from the stabilizing portion 117 in a downward direction toward the y-axis 120 such that the x-coordinate of the distal end of the middle bend portion 118 is close to the x-coordinate of the proximal end of the hand grip portion 119 in FIG. 2. In one embodiment depicted in FIG. 2, the x and y coordinates of the distal end of the middle bend portion 118 are approximately (0,0). The middle bend portion 118 is configured to be at an angular orientation $\beta$ with respect to the stabilizing portion 117 in the range of 90° to 180°. In one embodiment of the ergonomic collapsible crutch 100, the angular orientation $\beta$ is approximately 135°.

The hand grip portion 119 projects from the distal end of the middle bend portion 118 in a generally vertical direction. In one embodiment of the ergonomic collapsible crutch 100, the hand grip portion 119 directly follows the y-axis 120 such that the x-coordinate of the proximal end of the hand grip portion 119 is close to the x-coordinate of the distal end of the hand grip portion 119. In one embodiment as depicted in FIG. 2, the x coordinate of the entire hand grip portion 119 is approximately zero. The hand grip portion 119 is configured to be at an angular orientation .theta. with respect to the middle bend portion 118 in the range of 90° to 180°. In one embodiment of the ergonomic collapsible crutch the angular orientation .theta. is approximately 135° such that the angular orientation 13 is approximately the same as the angular orientation .theta. The hand grip portion 119 extends beyond the hand grip 103 to provide dual snap buttons for the folding mechanism 104 of the crutch allowing for collapsibility.

The alignment rib 115 provides the connection between the supporting member 102 via the hand grip portion 119 and the adjustable portion 116. The hand grip portion 119 of the supporting member 102 includes dual snap buttons 105 to accommodate patients of varying heights. Alternative devices may be used as a latching mechanism instead of the illustrated dual snap buttons 105. For example, a single pin radially biased outward would be sufficient. In one embodiment of the ergonomic collapsible crutch the adjustable portion 116 is connected to a shock absorbing portion 106 to lessen impact on a patient. Additionally, a gripping pad 107 is at the end of the crutch to provide stability and grip on uneven or slick surfaces.

Figure 3:
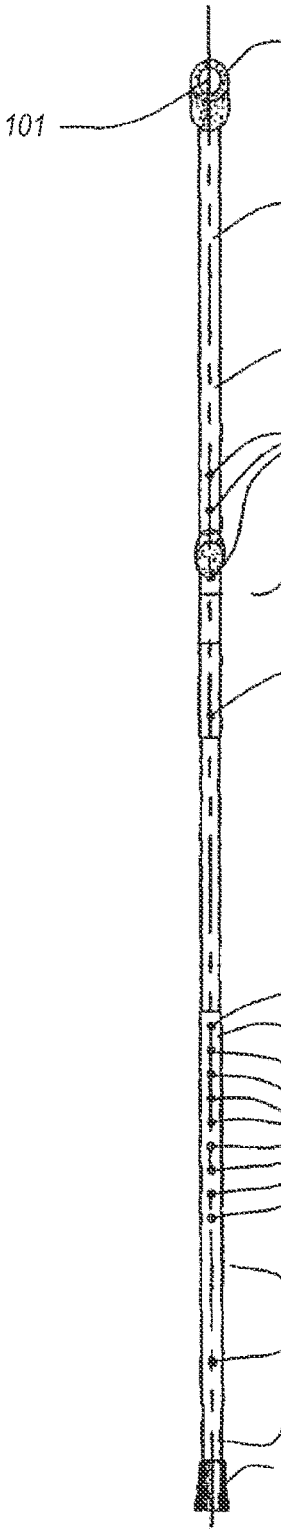
FIG. 3 is front elevation view of an embodiment of the full-sized crutch.
Figure 4:
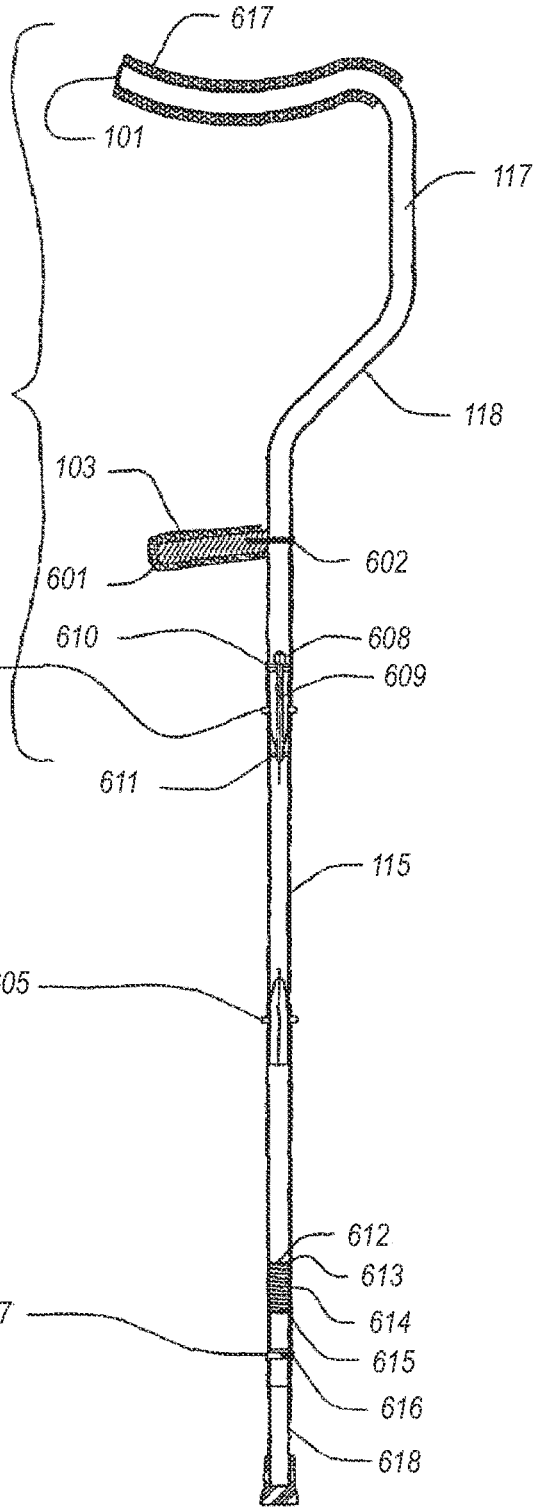
FIG. 4 is a cross-sectional side elevation view of the full-sized crutch.

FIGS. 3 and 4 illustrate the underarm pad 617, hand grip portion 119, the two snap assembly of the folding mechanism 604, the two snap assembly of the height adjustment mechanism 605, the shock absorbing portion 106 and the gripping pad 107.

The underarm pad 617 may be generally cylindrical in shape and may be fabricated with an elastomeric material such as EVA, urethane foam, neoprene foam, PVC, natural rubber, cork or any other possible materials. The exterior diameter of the underarm pad 617 may be custom designed to fit a patient's desired thickness and density. The interior diameter of the underarm pad 617 may also be custom designed to fit the diameter of the underarm support 101. In addition, the underarm pad 617 is removable/replaceable in the event an alternative material, thickness, diameter and/or density is desired. The underarm support 101 is a portion of the supporting member 102 and is connected to the hand grip portion 119, via the stabilizing portion 117 and the middle bend portion 118.

The hand grip portion 119 has a series of diametrically opposed hand grip adjustment apertures 603 to allow the hand grip 103 to be placed in a variety of positions to accommodate height adjustment and a patient's desired orientation of the crutch. The hand grip portion 119 is further described and illustrated in FIGS. 5 through 7. The distal end of the hand grip portion 119 extends beyond the hand grip 103 to provide dual snap buttons for the folding section 104 of the crutch allowing for collapsibility. The dual snap buttons for the folding mechanism 204 are designed to release the crutch into two connected pieces by disengaging the hand grip portion 119 from the alignment rib 115. Alternative devices may be used as a latching mechanism instead of the illustrated dual snap buttons 104. For example, a single pin radially biased outward would be sufficient. The folding mechanism is further described in illustrated in FIGS. 9 and 10. The alignment rib 115 engages with the adjustable portion 116 via dual snap buttons 205 for height adjustment. The adjustable portion 116 has a series of diametrically opposed apertures 206 allowing for a customized crutch length to accommodate varying patient heights.

Figure 5:
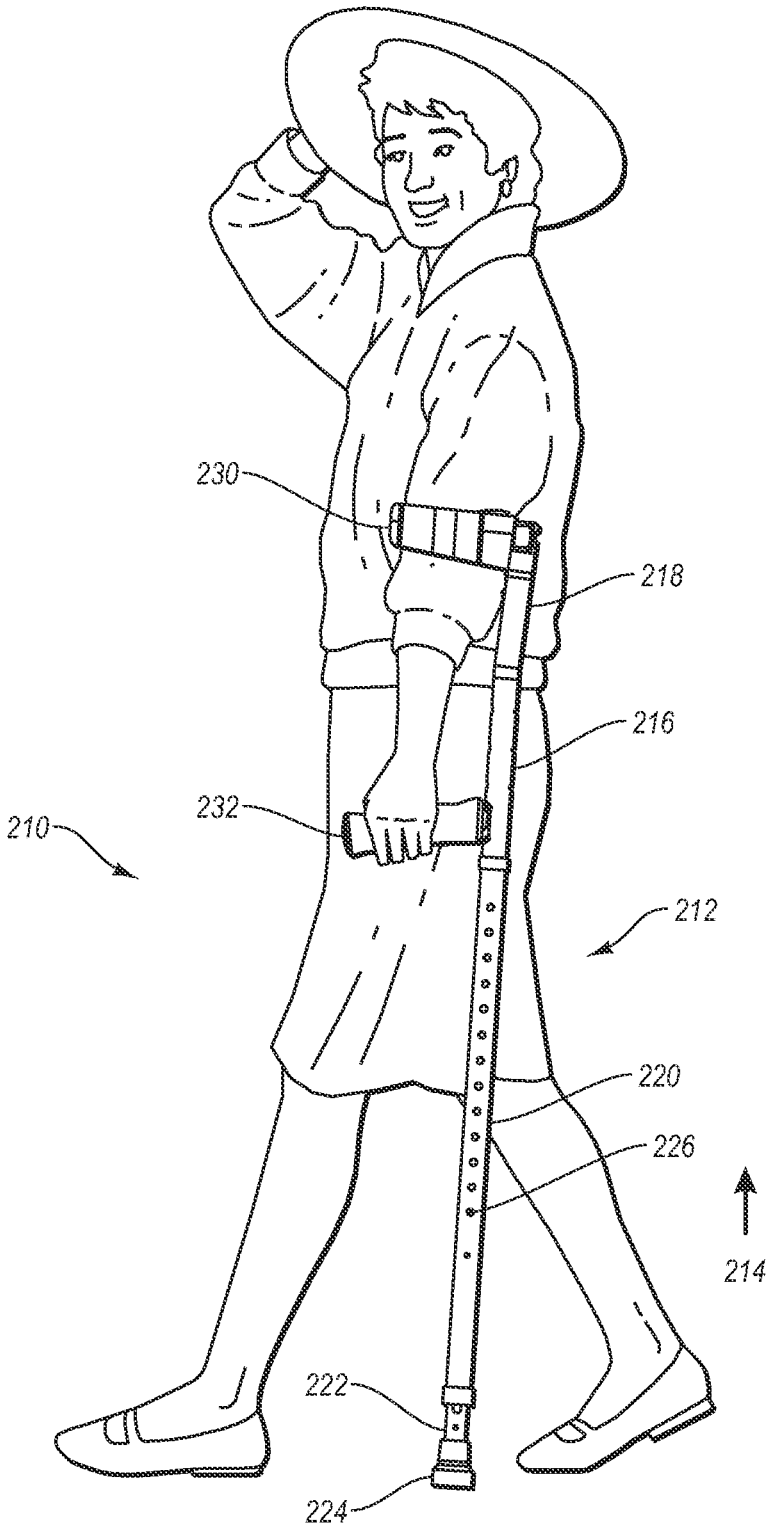
FIG. 5 is a side elevation view of an embodiment of a forearm crutch with respect to a patient.
Figure 6:
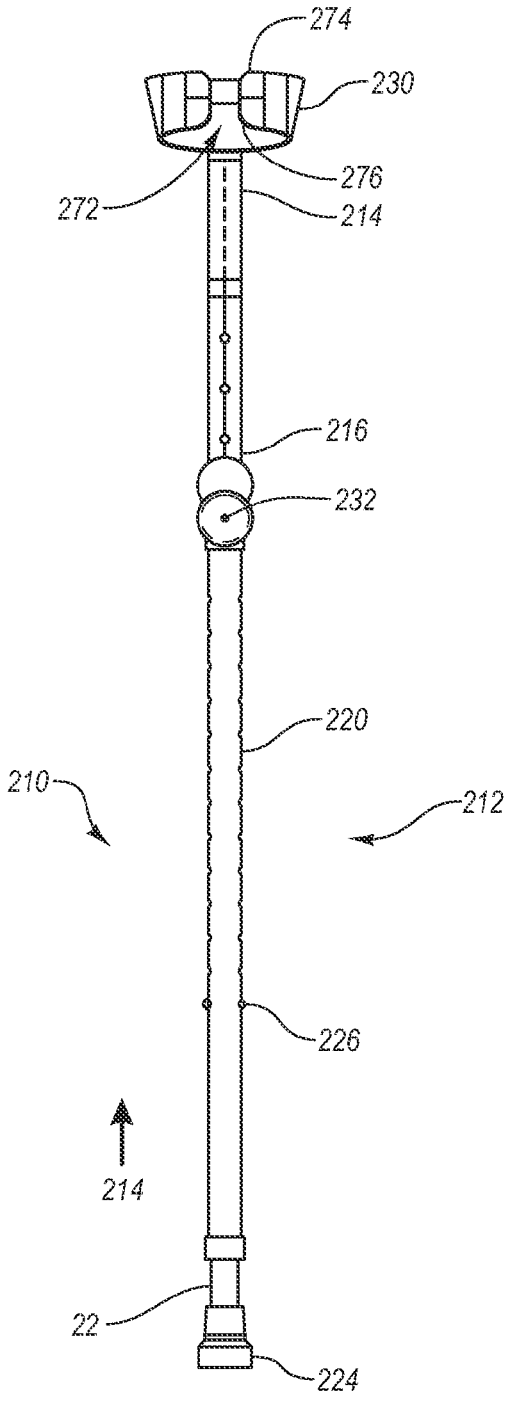
FIG. 6 is a side elevation view of an embodiment of the forearm crutch.
Figure 7:
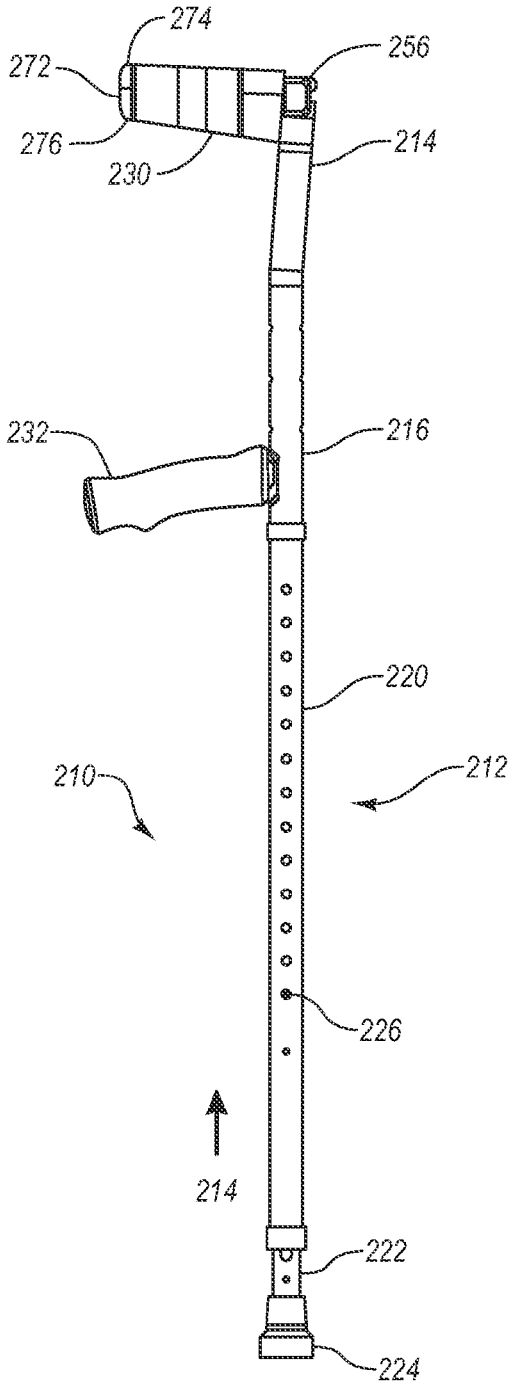
FIG. 7 is a front elevation view of an embodiment of the forearm crutch.

Reference will now be made to FIGS. 5-7, which illustrate a cane crutch. FIG. 5 illustrates an embodiment of an ergonomic forearm crutch 210. As illustrated in FIG. 5, the forearm crutch 210 is in use by a patient. A patient is intended to include any user of the device. As will be discussed more fully below, the forearm crutch 210 provides significant advantages over conventional forearm crutches in that it is capable of ergonomically maintaining the arm and wrist of the user in a neutral position. Neutral position is defined as maintaining the user's third metacarpal generally aligned with the user's radius. This is achieved throughout essentially the entire walking motion of the patient.

As illustrated in FIGS. 5-7, the crutch 210 includes a supporting member 212 which supports the various structures of the crutch 210. The supporting member 212 provides support to the patient during use of the crutch. The supporting member 212 has a generally vertical axis 214. The supporting member 212 can include various sections. As illustrated in FIG. 5, these sections include a generally vertically oriented forearm support section 218. As illustrated, the forearm support section 218 may be angled slightly away from vertical in order to allow for attachment and orientation of the forearm cuff 230.

Also connected to the forearm support section 218 is a generally vertically oriented hand grip portion 216. As will be discussed in additional detail below, the hand grip portion 216 allows for attachment and orientation of the hand grip 232.

Connected to the hand grip portion 16 is a generally vertically oriented adjustable portion 220. The adjustable portion 220 each has dual snap buttons 226 which facilitate height adjustment of the crutch 210. Thus, the supporting member 212, through its components, provides support for the forearm crutch 210 structure.

The entire supporting member 212, including the hand grip portion 216, forearm support section 218, and adjustable portion 220 may be fabricated of metal such as aluminum, steel, or titanium, and are formed in a generally hollow cylindrical shape. The internal and external diameter of the supporting member 212 and the various sections thereof can be of varying dimensions to accommodate a patient's needs and to provide for the pieces of the crutch to fit together. For example, a pediatric patient may utilize a crutch with a smaller external diameter than an adult patient.

Also illustrated in FIG. 5 is a shock absorbing portion 222. In some embodiments the shock absorbing portion 222 may include a spring mechanism for absorbing shock. These embodiments will be discussed in additional detail below. Attached to the base of the shock absorbing portion 222 is a gripping pad 224. The gripping pad 224 may be a conventional grip pad of the type generally use in crutches. Alternatively, the grip pad may be an articulated grip pad, as discussed below and as illustrated in FIGS. 12-14.

The shock absorbing portion 222 may be used at the distal end of the adjustable portion 220 to assist in ambulating over uneven surfaces and to provide a cushioning effect. The distal end of the crutch has a gripping pad 224 that provides appropriate friction between the crutch 210 and the walking environment. The gripping pad 224 may be formed of an elastomeric material such as EVA, urethane foam, neoprene foam, PVC, natural rubber, cork or any other possible materials.

As indicated above, the adjustable portion 220 of the supporting member 212 includes dual snap buttons 226 to accommodate patients of varying heights. Alternative devices may be used as latching mechanisms instead of the illustrated dual snap buttons 226. For example, a single pin radially biased outward would be sufficient.

The hand grip 232 is attached to the hand grip portion 16 of the supporting member 212 in such a manner that the forearm crutch 210 is ergonomic, as that term has been defined above. In particular, the hand grip 232 is provided with appropriate contours and ergonomic angulation to fit the palm and align the wrist. The hand grip 232 may be fabricated of elastomeric material such as EVA, urethane foam, neoprene foam, PVC, natural rubber, cork or any other possible materials.

The hand grip 232 is adjustable to maintain the wrist of a patient in the neutral position, which position has been described as a line passing though the middle of the third metacarpal being parallel to a line passing through the middle of the radius. The adjustability of hand grip 232 allows for easier grip, decreased stress and decreased risk of injury to the wrist. The ergonomic design of the hand grip 232 encourages spreading of the force load from grasping forces over as large an area as possible.

Also as illustrated in FIG. 6, the cuff 230 is molded in a v-shape so that the cuff diameter at the top of the cuff is wider than the diameter at the bottom of the cuff thereby creating an ergonomic contour similar to the contour of the user's forearm. Additionally, the cuff opening 272 is molded in a v-shape such that the top 274 of the cuff opening 272 is wider than the bottom 276 of the cuff opening 272. In one embodiment of the ergonomic cuff 230, the width at the top 274 of the cuff opening 272 is in the range of about 0.5 to about 1.25 inches or from about 12.7 to about 31.75 millimeters and more preferably at the width of 0.875 inches or 22.2 millimeters, while the width at the bottom 276 of the cuff opening 272 is in the range of about 0.1 to about 0.4 inches or from about 2.54 to about 10.16 millimeters and more preferably at the width of 0.25 inches or 6.35 millimeters. While it is anticipated that the overall diameter of the cuff 230 may change to accommodate different sizes of forearms, the range of the cuff opening 272 will remain within the ranges as discussed above.

As illustrated in FIG. 7, the cuff hinge 256 is integrated into the cuff 230 so that the cuff 230 and the cuff hinge 256 are one piece of molded material thereby reducing the number of individual parts needed for adjustment of the cuff 30 angle with respect to the vertical axis 214.

Figure 8:
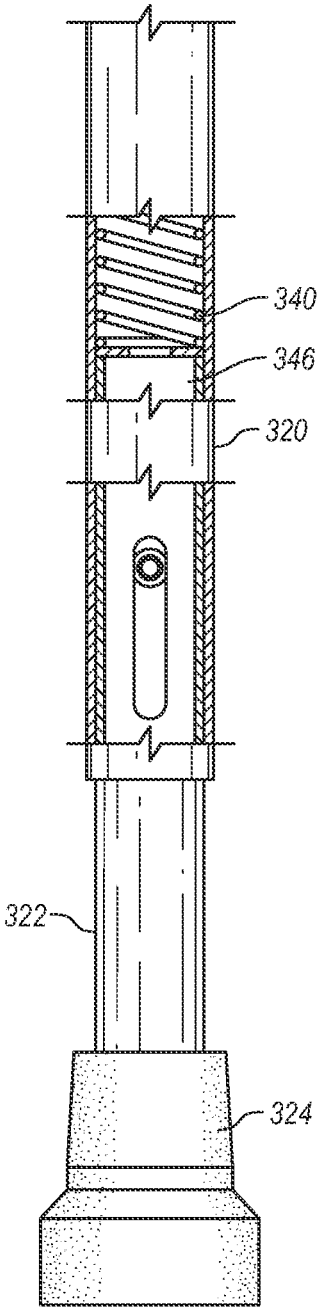
FIG. 8 is a partial cross-sectional side elevation view of an embodiment of a crutch shock absorbing mechanism.
Figure 9:
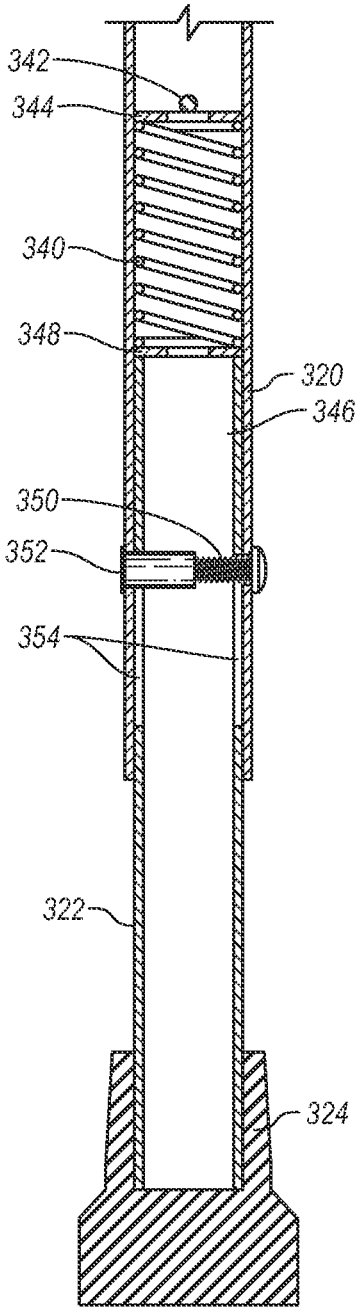
FIG. 9 is a partial cross-sectional side elevation view of an embodiment of the crutch shock absorbing mechanism in the relaxed position.
Figure 10:
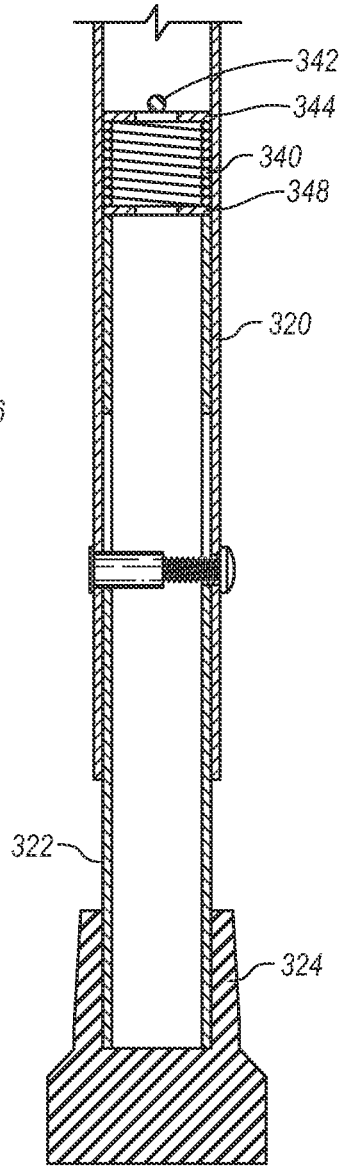
FIG. 10 is a partial cross-sectional side elevation view of an embodiment of the crutch shock absorbing mechanism in the compressed position.
Figure 11:
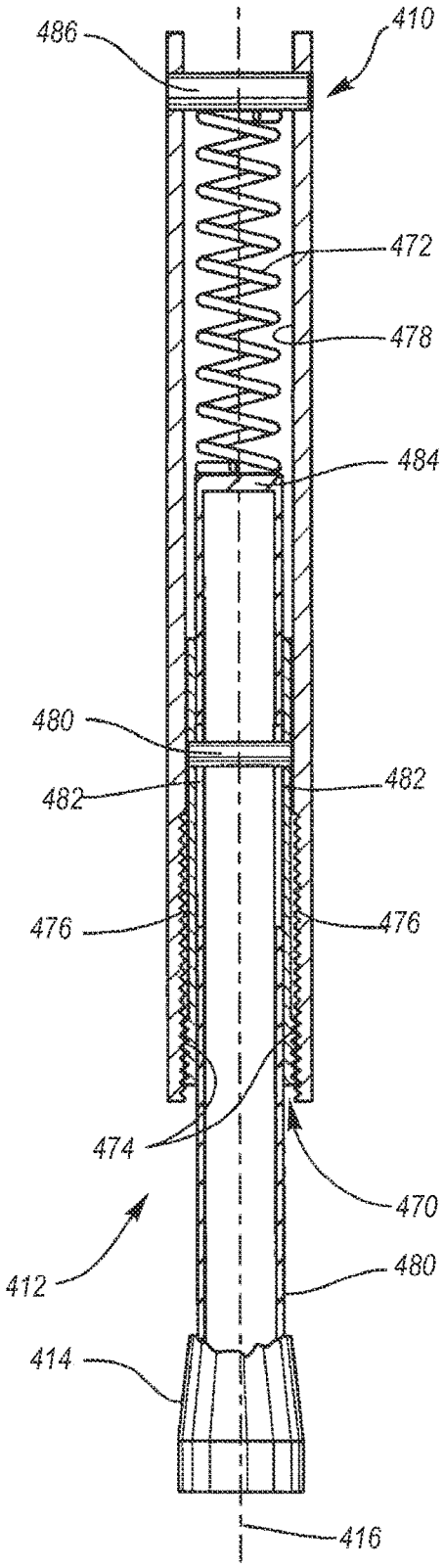
FIG. 11 is a cross-sectional view of another embodiment of a shock absorbing mechanism.

In some embodiments, as discussed above, an ergonomic forearm crutch includes a shock absorbing portion. FIGS. 8-10 illustrate one embodiment of a shock absorbing portion of a crutch. FIG. 11 illustrates another embodiment of a shock absorbing portion of a crutch.

FIGS. 8-10 illustrate one embodiment of the shock absorbing portion 322. In one embodiment, a spring 340 is used to provide a shock absorbing mechanism, as illustrated in FIGS. 8-10. Alternative shock absorbing devices are possible, including but not limited to gas assisted shocks, hydraulic shocks and pneumatic shocks. The spring 340 is contained within the lower half of the adjustable portion 320. The proximal end of the spring 340 is held in place with a retaining pin 342 and an upper retaining washer 344. The distal end of the spring 340 contacts the proximal end portion of the shock bar 346 via a lower retaining washer 348. The shock bar 346 has a smaller external diameter than the internal diameter of the adjustable portion 320, such that the shock bar 346 can telescope into and out of the adjustable portion as required by the pressure exerted by a patient. A machine screw 350 connected with a tee nut 352 secures the adjustable portion 320 to the shock bar 346. The tee nut 352 extends through a longitudinally elongated aperture 354 in which the machine screw 350 connected with the tee nut 352 can slide.

FIG. 9 illustrates a shock absorbing portion 322 in its relaxed state such that the spring 340 is extended. FIG. 10 illustrates a shock absorbing portion in its compressed state such that the spring 340 is compressed. The shock bar 346 is finished off at its end with a gripping pad 324 that acts as a support element on the ground. This pad 324 is made of the appropriate elastomeric material with its gripping surface ribbed, corrugated, spiked, or otherwise made to grip the surface to reduce friction. The pad 324 is made such that the proximal portion of the pad 324 fits onto the distal end of the crutch, with an articulation with the distal portion such that it can accommodate 120 degrees of motion. The articulation may include a hinge, ball in socket, sliding joint, or other means to allow for movement, as discussed below with reference to FIGS. 12-14.

FIG. 11 illustrates a cross-sectional view of another embodiment of a shock absorbing portion of a crutch. The shock absorbing device 412 may be disposed between a supporting member 402 and the gripping pad 414. In FIG. 11, the shock bar 480 of the shock absorbing device 412 is attached to the gripping pad 414 and extends into the adjustable portion 410.

The shock absorbing device 412 also includes a sleeve 470 and a spring 472. The sleeve 470 includes a thread 474 that engages a thread 476 that is connected to the supporting member. In different configurations, the thread 474 of the sleeve 470 may be external or internal. More precisely in this configuration, the thread 474 of the sleeve 470 is an external thread. The thread 476 is disposed on an internal surface 478 of the adjustable member 410, which is connected to the supporting member 402 through the alignment rib 408.

The shock bar 480 is slidably attached to the sleeve 470 by a guide pin 480 that extends through the sleeve 470 and through a longitudinally elongated aperture 482 of the shock bar 480. Therefore, shock bar 480 is able to slide the length of the longitudinally elongated aperture 482 less the diameter of the guide pin 480 within the sleeve 470. The shock bar 480 also includes rear plate 484 that may be coupled to or abut the spring 472. The other end of the spring 472 is positioned within the adjustable portion 410 by a retaining pin 486 extending through and attached to the adjustable portion 410.

The spring rate of the spring 472 is adjustable and thus, the shock absorbing device 412 is also adjustable. The spring rate of the spring 472 is adjusted as the shock bar 480 or the sleeve 470 is rotated within the adjustable portion 410. As the shock bar 480 or the sleeve 470 is rotated, the external threads 474 of the sleeve 470 engage the internal threads 476 of the adjustable portion 410 to move the sleeve 470 and the guide pin 480 along the vertical axis 416 within the adjustable portion 410.

As the guide pin 480 moves closer to the retaining pin 486, the spring 472 is compressed by the rear plate 484 of the shock bar 480. Thus, when the crutch 400 is used by a user, the shock absorbing device 412 is stiffer and provides a harder cushioning of the impacts resulting from use. Conversely, as the guide pin 480 moves further from the retaining pin 486, the spring 472 is decompressed. Thus, when the crutch 400 is used by a user, the shock absorbing device 412 provides a softer cushioning of the impacts resulting from use. Additionally, a bushing may be used around the shock bar 480 to slow the movement of the shock bar 480 within the sleeve 470.

Reference will now be made to FIGS. 12-14, which illustrate an embodiment of a gripping pad (or pad) 507 disposed at the distal end of a crutch's vertical support 506. This pad 507 is made of an appropriate elastomeric material such as EVA, urethane foam, neoprene foam, PVC, natural rubber, cork or any other possible materials. The pad has a bottom, gripping surface 520 that is ribbed, corrugated, spiked, or otherwise made to grip the ground surface. The pad surface 520 provides appropriate friction between the crutch and the walking environment.

The pad 507 is made such that the proximal portion of the pad 507 securely fits onto the distal end of a crutch vertical support 506. Particularly, the pad 507 includes a bore channel 516 and a bore cavity 518 sized to securely receive the distal end of the vertical support 506. The distal end of the vertical support 506 includes a generally spherical end (also referred to as a "ball") 514 that acts like the ball of a ball and socket joint when inserted into the bore of the pad 507. The bore channel 516 and the ball are of appropriate dimensions such that the bore channel can receive the ball 514 without tearing the elastomeric material. When received, the ball 514 is positioned within the bore cavity 518 and the bore channel 516 contacts the vertical support 506 and holds the ball securely in place. In some embodiments the bore cavity 518 is in direct contact with the received ball 514. In other embodiments, the bore cavity 518 has dimensions, just wider than the ball, such that the ball 514 has minimal contact with the bore cavity 518. In other embodiments, a portion of the ball 514 contacts the bore cavity 518, for instance 30%-70% of the ball surface area may be in contact with the bore cavity 518.

In some embodiments, a socket is disposed between the bottom of the bore cavity 518 and the vertical support 506. The socket is made of an appropriate material that allows the ball 514 to rotate and/or pivot within the socket. For example, the socket may include a metal, a composite, a plastic, or combinations thereof. The ball 514 and socket form a ball and socket joint wherein the ball 514 pivots and rotates within the socket in response to movement of the vertical support 506 by a user. Thus, the vertical support 506 articulates with the grip pad 507 to form an articulated grip pad 510.

In some embodiments the socket is a washer 512 disposed between the bottom of the bore cavity 518 and the vertical support 506. In one embodiment, the washer 512 is a metal washer having a hole 513 through its center, as illustrated in FIG. 13. When the ball 514 is disposed in the bore cavity 518 it rests within the hole 513 of the washer 512 and makes contact with the inner edges of the hole 513. In some embodiments, the washer has a smooth or tapered inner edge so as to reduce surface friction between the ball and the inner edge of the washer.

Various different socket implementations may be used to produce a working articulated grip pad 510. In some embodiments, the socket includes a flat disk. In some embodiments, the washer includes a concave disk that receives the ball within the concave surface of the disk. In some embodiments the socket is a receptacle having a hemispherical surface. In some embodiments, the socket includes a locking means for locking the ball in place after it is inserted into the socket. In some embodiments, a lubricating material is disposed between the ball 514 and the socket. This lubricating material may be a solid, such as a Teflon™ or other lubricating coating. Alternatively, the lubricating material may be a liquid, gel, or powder that reduces friction between the two contacting surfaces. For instance, a layer of lubricating oil may be applied between the ball and socket.

In some embodiment, the grip pad 507 includes an annular groove 508 formed in the outer surface of the grip pad 507. As illustrated, the bottom portion of the annular groove 508 is substantially opposite the bottom portion of the bore cavity 518. When in use, the annular groove 508 allows the bottom surface 520 of the grip pad 507 to maintain contact with ground while the top portion of the grip pad 507 pivot towards and away from the of the bottom surface.

In use, non-articulated grip pads (such as that illustrated in FIG. 4) pivot at the bottom surface of the grip pad. This pivoting causes the bottom grip pad to roll rather than maintain constant contact with the ground surface. In contrast, the articulated grip pad 510 allows the bottom surface 520 to maintain contact with the ground because it has a pivot point at the points of contact between the ball 514 and the socket. This provides improved traction and support to the crutch. In addition, the articulated grip pad 510 facilitates use and movement of the crutch by decreasing the resistance to pivoting. Accordingly, the articulated grip pad 510 can accommodate approximately 120 degrees of motion while the bottom surface 520 of the grip pad 507 maintains contact with the ground.

Figure 15:
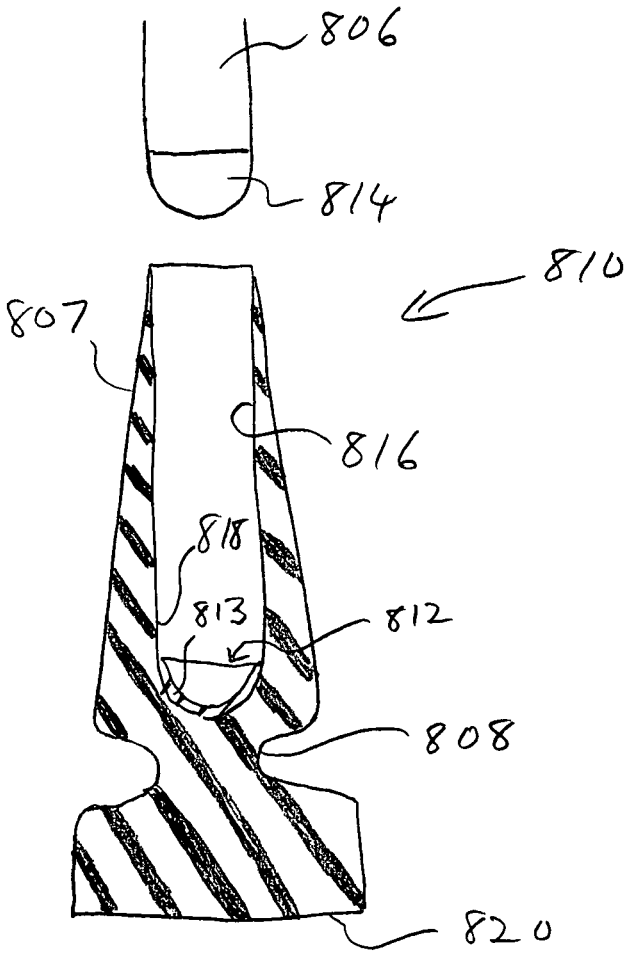
FIG. 15 is a side elevation view of an articulated grip pad according to an alternative embodiment of the invention.

Referring to FIG. 15, an articulated grip pad is illustrated according to one alternative embodiment of the invention. The grip pad 807 is disposed at the distal end of a crutch's vertical support 806. This pad 807 is made of an appropriate elastomeric material such as EVA, urethane foam, neoprene foam, PVC, natural rubber, cork or any other possible materials. The pad 807 has a bottom, gripping surface 820 that is ribbed, corrugated, spiked, or otherwise made to grip the ground surface. The gripping surface 820 provides appropriate friction between the crutch and the walking environment.

The pad 807 is made such that the proximal portion of the pad 807 securely fits onto the distal end of a crutch vertical support 806. Particularly, the pad 807 includes a bore channel 816 and a bore cavity 818 sized to securely receive the distal end of the vertical support 806. The distal end of the vertical support 806 includes semispherical surface 814, which is a surface, defining at least some sectorial portion of a spherical surface. The semispherical surface 814 may act like the ball of a ball and socket joint when inserted into the bore of the pad 807. The bore channel 816 and the semispherical surface 814 are of appropriate dimensions such that the bore channel 816 can receive the semispherical surface 814 without tearing the elastomeric material. When received, the semispherical surface 814 is positioned within the bore cavity 818 and the bore channel 818 contacts the vertical support 806 and holds the semispherical surface securely in place.

A socket 812 is disposed between the bottom of the bore cavity 818 and the vertical support 806. The socket 812 is made of an appropriate material that allows the semispherical surface 814 to rotate and/or pivot within the socket 812. For example, the socket 812 may include a metal, a composite, a plastic, or combinations thereof. The semispherical surface 814 and socket 812 may form a ball and socket joint wherein the semispherical surface 814 pivots and rotates within the socket 812 in response to movement of the vertical support 806 by a user. Thus, the vertical support 806 articulates with the grip pad 807 to form an articulated grip pad 610.

In this embodiment, the socket 812 is a washer 812 disposed between the bottom of the bore cavity 818 and the vertical support 806. The socket 812 has a substantially hemispherical surface 813 with a concave shape. A "substantially hemispherical surface" is a semispherical surface that is a half-sphere, approximates a half-sphere, or embraces a spherical sector that is nearly a complete hemisphere. When the semispherical surface 814 is disposed in the bore cavity 818 it rests within the substantially hemispherical surface 813. The washer 812 may have a smooth or tapered inner edge so as to reduce surface friction between the semispherical surface 814 and the inner edge of the washer 812.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A crutch comprising:

a vertical supporting member of a crutch;

a semispherical surface fixedly secured to a bottom end of the vertical supporting member; and a gripping pad having a distal end defining a gripping surface shaped to engage a ground surface, and a proximal end having a socket, wherein the semispherical surface is securely received into the socket to articulate with an abutting surface within the socket such that the abutting surface does not extend outward from the socket into the gripping pad;

wherein the gripping pad is formed of a flexible material and is shaped to flex during use of the crutch to allow pivoting motion between the distal and proximal ends as the semispherical surface articulates with the abutting surface;

wherein the vertical supporting member and the semispherical surface have the same diameter and are, within the socket, free of any element that protrudes diametrically into the gripping pad.

2. The crutch of claim 1, wherein the socket includes a washer on which the abutting surface is located.

3. The crutch of claim 2, wherein the abutting surface comprises a substantially hemispherical surface.

4. The crutch of claim 1, wherein the gripping pad includes an annular groove disposed on its exterior surface, wherein the annular groove defines a thinner section of the gripping pad between the proximal and distal ends of the gripping pad to facilitate the pivotal motion, wherein the annular groove is positioned distally of a center of the semispherical surface.

5. The crutch of claim 1, wherein the vertical supporting member further comprises a shock absorbing device.

6. The crutch of claim 5, wherein the shock absorbing device comprises a spring coupled to a shock bar, wherein the spring rate of the spring is adjustable.

7. The crutch of claim 1, further comprising a hand grip extending outwardly from the vertical supporting member at an angle of about 10° to about 30° downwardly below horizontal, wherein the hand grip extends outwardly from the hand grip at an angle such that the wrist of a user of average anatomical proportions is generally maintained in a neutral position such that the user's third metacarpal is generally aligned with the user's radius.

8. The crutch of claim 7, wherein the hand grip extends outwardly from the vertical supporting member at an angle of about 15° to about 25° downwardly below horizontal.

9. The crutch of claim 1, wherein the proximal end is shaped to define a bore channel that provides access to the socket, wherein the bore channel is sized to contact the vertical supporting member to hold the semispherical surface in position relative to the abutting surface.

10. A crutch comprising:

a vertical supporting member of a crutch;

a semispherical surface coupled to a bottom end of the vertical supporting member;

a gripping pad having a distal end defining a gripping surface shaped to engage a ground surface, and a proximal end having a socket, wherein the semispherical surface is securely received into the socket to articulate with an abutting surface within the socket to allow pivoting motion between the distal and proximal ends as the semispherical surface articulates with the abutting surface such that a center of the semispherical surface is between the distal and proximal ends; and a washer on which the abutting surface is located, wherein the abutting surface comprises a substantially hemispherical surface and the washer does not extend outward from the socket into the gripping pad;

wherein the gripping pad is formed of a flexible material and is shaped to flex during use of the crutch to allow pivoting motion between the distal and proximal ends as the semispherical surface articulates with the abutting surface;

wherein the vertical supporting member and the semispherical surface have the same diameter and are, within the socket, free of any element that protrudes diametrically into the gripping pad.

11. The crutch of claim 10, wherein the gripping pad includes an annular groove disposed on its exterior surface, wherein the annular groove defines a thinner section of the gripping pad between the proximal and distal ends of the gripping pad to facilitate the pivotal motion; wherein the annular groove is positioned distally of a center of the semispherical surface.

12. The crutch of claim 10, wherein the proximal end is shaped to define a bore channel that provides access to the socket, wherein the bore channel is sized to contact the vertical supporting member to hold the semispherical surface in position relative to the abutting surface.

13. The crutch of claim 10, wherein the vertical supporting member further comprises a shock absorbing device comprising a spring coupled to a shock bar, wherein the spring rate of the spring is adjustable.

14. The crutch of claim 10, further comprising a hand grip extending outwardly from the vertical supporting member at an angle of about 15° to about 25° downwardly below horizontal, wherein the hand grip extends outwardly from the hand grip at an angle such that, during use of the crutch, the wrist of a user of average anatomical proportions is generally maintained in a neutral position such that the user's third metacarpal is generally aligned with the user's radius.

15. A crutch comprising:

a vertical supporting member of a crutch;

a semispherical surface coupled to a bottom end of the vertical supporting member; and a gripping pad having a distal end defining a gripping surface shaped to engage a ground surface, and a proximal end having a socket, wherein the semispherical surface is securely received into the socket to articulate with an abutting surface within the socket to allow pivoting motion between the distal and proximal ends as the semispherical surface articulates with the abutting surface such that a center of the semispherical surface is between the distal and proximal ends;

wherein the gripping pad is formed of a flexible material and is shaped to flex during use of the crutch to allow pivoting motion between the distal and proximal ends as the semispherical surface articulates with the abutting surface;

wherein the gripping pad comprises an annular groove disposed on its exterior surface, wherein the annular groove defines a thinner section of the gripping pad between the proximal and distal ends of the gripping pad to facilitate the pivotal motion, wherein the annular groove is closer than the center of the semispherical surface to the distal end of the gripping pad;

wherein the vertical supporting member and the semispherical surface have the same diameter and are, within the socket, free of any element that protrudes diametrically into the gripping pad.

16. The crutch of claim 15, wherein the socket includes a washer on which the abutting surface is located.

17. The crutch of claim 15, wherein the proximal end is shaped to define a bore channel that provides access to the socket, wherein the bore channel is sized to contact the vertical supporting member to hold the semispherical surface in position relative to the abutting surface.

18. The crutch of claim 15, wherein the vertical supporting member further comprises a shock absorbing device comprising a spring coupled to a shock bar, wherein the spring rate of the spring is adjustable.

19. The crutch of claim 15, further comprising a hand grip extending outwardly from the vertical supporting member at an angle of about 10° to about 30° downwardly below horizontal, wherein the hand grip extends outwardly from the hand grip at an angle such that, during use of the crutch, the wrist of a user of average anatomical proportions is generally maintained in a neutral position such that the user's third metacarpal is generally aligned with the user's radius.

20. The crutch of claim 19, wherein the hand grip extends outwardly from the vertical supporting member at an angle of about 15° to about 25° downwardly below horizontal.

* * * * *